United States Patent [19]

Kii

[11] 4,228,333

[45] Oct. 14, 1980

[54] CIRCUIT INTERRUPTER HAVING CONTROLLED RATE OF ARC EXTINGUISHMENT

[75] Inventor: Masami Kii, Amagasaki, Japan

[73] Assignee: Mitsubishi Denki Kabushiki Kaisha, Tokyo, Japan

[21] Appl. No.: 926,131

[22] Filed: Jul. 19, 1978

[30] Foreign Application Priority Data

Jul. 21, 1977 [JP] Japan ..... 52/88073

[51] Int. Cl.[2] ..... H01H 33/70

[52] U.S. Cl. ..... 200/148 R; 200/148 F

[58] Field of Search ..... 200/148 R, 148 A, 148 B, 200/148 C, 148 D, 148 E, 148 F, 148 G, 148 H, 148 J, 148 BV, 150 B, 150 G, 144 R

[56] References Cited

U.S. PATENT DOCUMENTS 1,904,539 4/1933 Ruppel ..... 200/148 F 3,514,563 5/1970 Stegmüller ..... 200/150 B

FOREIGN PATENT DOCUMENTS 47-29345 12/1972 Japan ..... 200/148 B 49-42465 4/1974 Japan ..... 200/148 B

OTHER PUBLICATIONS

"Construction of An Electrode of A Gas Puffing Circuit Interrupter", by Iwamoto et al.

"Gas Type Interrupter", by Iwamoto et al.

*Primary Examiner*—J. V. Truhe

*Assistant Examiner*—Morris Ginsburg

*Attorney, Agent, or Firm*—Oblon, Fisher, Spivak, McClelland & Maier

[57] ABSTRACT

A circuit interrupter comprises a pair of contacts being relatively moved to be detachable in an arc extinct chamber filled with a fluid for arc extinction; a pressurizing chamber for storing the fluid pressurized in an arc space in which the arc is formed by the departing operation of the contacts; and speed control means for controlling a speed for departing the contacts to at least two steps and said speed control means is connected to a driving system for the contacts wherein the fluid is discharged through the arc space out of the arc extinct chamber after departing the contacts for a specific distance and the arc is interrupted by puffing the fluid.

5 Claims, 2 Drawing Figures

CIRCUIT INTERRUPTER HAVING CONTROLLED RATE OF ARC EXTINGUISHMENT

BACKGROUND OF THE INVENTION

1. Field of the Invention

The present invention relates to a circuit interrupter such as a self-arc extinction type circuit interrupter in which high pressure fluid e.g. $SF_6$ gas whose pressure is raised by the arc formed between contacts, is used for performing the arc extinction.

2. Description of the Prior Arts

In the conventional circuit interrupters, a fluid in a suitable volumetric space is pressurized by the pressurizing function of arc energy transmitted from the arc to the fluid filled in the space and the pressurized fluid is released from an opening closed by the arc through the arc spacer under periodical changes of the arc current. decreasing it to zero and the arc extinction is attained by the resulting puffing effect and cooling effect.

In such self-arc extinction type circuit interrupter, it is important to provide directly or indirectly the pressurized fluid source by the pressurizing function. The function of the arc extinction is highly affected depending upon the means for providing the pressurized fluid. The function for forming the pressurized fluid source for a short time is the most important and indispensable function for the power of the arc extinction and it is the indispensable factor for a circuit interrupter having a short arcing time.

In general, the pressurized fluid source is provided by the pressurizing function of the arc heat energy in the self-arc extinction type circuit interrupter. In order to obtain a desired pressurizing function, it is necessary to control the arc energy as the source of the pressurizing function.

SUMMARY OF THE INVENTION

In general, the arc energy is given as a product of an arc current to an arc voltage (current × voltage) and the arc current is not easily controlled because of the current in the circuit whereas the arc voltage can be effectively controlled in a practical operation. The arc voltage is depending upon an arc length and pressure of the fluid in the arc space and the arc voltage is raised depending upon the increase of either of the arc length or the pressure of the fluid.

It is an object of the present invention to provide a circuit interrupter having a short arcing time resulted by effectively improving the pressurizing function for a short time in the initiation of departing contacts.

It is another object of the present invention to provide a circuit interrupter wherein a speed for departing contacts is controlled in two steps to precisely impart the pressurizing function in a simple structure.

It is the other object of the present invention to provide a circuit interrupter wherein a speed for departing contacts is controlled in two steps to decelerate the speed in the latter step whereby a needless elongation of the arc is controlled to control excess arc energy in the arc space and to prevent excess elevation of temperature of the pressurized fluid.

It is a further object of the present invention to provide a circuit interrupter having excellent function for the arc extinction in a wide range of the arc current and having excellent function for a stable operation wherein the energy for the operation is significantly reduced by effectively utilizing the arc energy.

The circuit interrupter according to the present invention comprises a pair of detachable contacts in an arc extinct chamber filled with a fluid for arc extinction such as $SF_6$ gas wherein the arc extinct chamber is switched from a closed state to an opened state at longer than a specific distance of the gap between the contacts whereby excellent circuit interrupting function can be attained by a simple structure regardless of the rated current and the interrupting current.

DETAILED DESCRIPTION OF THE PREFERRED EMBODIMENTS

Figure 1:
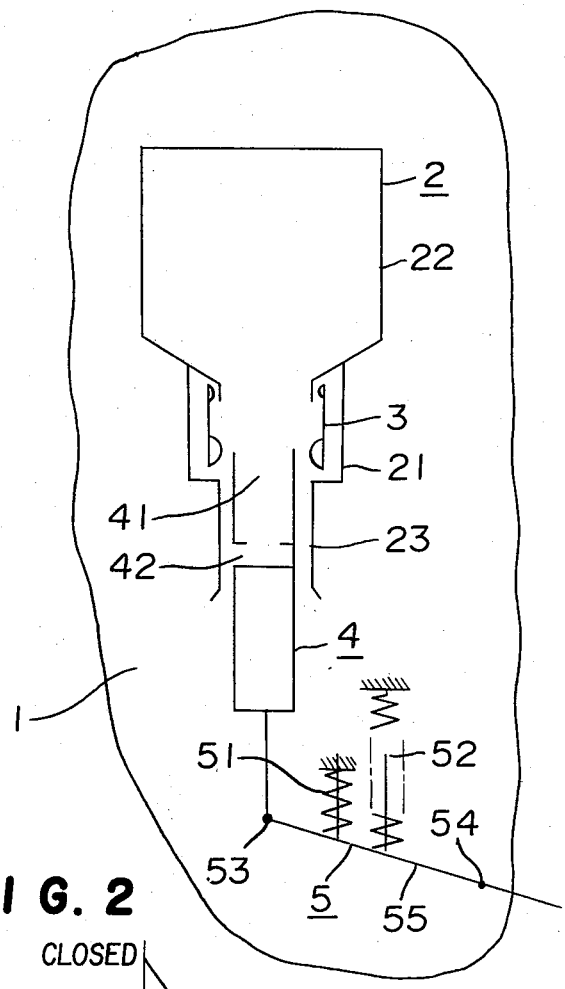
FIG. 1 is a schematic view of a structure of one embodiment of the circuit interrupter according to the present invention.
Figure 2:
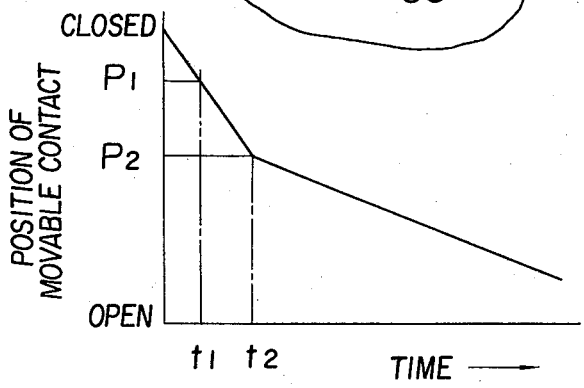
FIG. 2 is a performance characteristic diagram for illustrating the operation of the embodiment.

Referring to FIGS. 1 and 2, one embodiment of the present invention will be illustrated in detail.

In FIG. 1, the reference numeral (1) designates a container filled with a fluid for arc extinction; (2) designates an arc extinct chamber filled with the fluid for arc extinction which is disposed in the container (1) and a pressurizing chamber (22) and a surrounding shell (23) at both sides of a body (21) of the chamber; (3) designates a fixed contact disposed in the arc extinct chamber (2) and (4) designates a movable contact which is disposed to be detachable to the fixed contact (3) and which comprises a passage (41) for the fluid and an outlet (42) for the fluid; (5) designates a control device which is disposed between the movable contact (4) and a driving device (not shown) and which comprises two kinds of springs (51), (52) for controlling the speed for departing the contacts in two steps as shown in FIG. 2 wherein the speed is fast from the closed position through the detaching position $P_1$ to the specific position $P_2$ and the speed is slow from the specific position $P_2$ to the opened position (discharging).

The surrounding shell (23) has suitable length for maintaining the outlet (42) of the movable contact (4) in the closed state until the movable contact (4) departs from the fixed contact (3) for a specific distance and the surrounding shell (23) is extended to the direction shifting the movable contact. The control device (5) comprises a lever (55) which is pivoted at a fulcrum (54) and is connected to the movable contact (4) at a connecting point (53) and two kinds of springs (51), (52) having different length which can actuate the lever (55). The working distance of the spring (52) is longer than that of the spring (51).

In FIG. 2, the reference $t_1$ designates the time for detaching the contacts (3), (4) and $t_2$ designates the time for changing the departing speed of the contact (4).

In said structure of the embodiment, the departing instruction is given to the driving device (not shown) and the movable contact (4) is rapidly accelerated depending upon the operation of the driving device whereby the movable contact (4) descends for the wiping distance from the fixed contact (3) and the movable contact (4) is detached from the fixed contact (3) at the point $P_1$ in FIG. 2 to form the arc between the contacts. Since both of the springs (51), (52) work against the lever (55), the departing speed of the movable contact (4) is fast. The arc is expanded for a short time by the movable contact (4) which is rapidly accelerated and is descended at high speed, whereby the arc voltage is rapidly raised to increase the arc energy and the pressurizing effect of the fluid in the space is increased. Accordingly, the pressure in the pressurizing chamber (22) reaches to the pressure required for the arc extinction, for a short time.

When the movable contact (4) passes through the point $P_2$ in FIG. 2, only spring (52) works against the lever (55), the movable contact is decelerated and is further descended. The outlet (42) of the movable contact (4) is passed through the end of the surrounding shell (23) near the point $P_2$, the passage (41) of the movable contact (4) is connected through the outlet (42) to the container (1), and the arc current decreases near zero. When the passage (41) is released from the closed state resulted by the arc, the arc extinction is immediately performed by the resulting puffing effect and the cooling effect of the pressurized fluid in the pressurizing chamber (22) at the time of decreasing the arc current to zero.

The movable contact (4) is decelerated at the latter step of the descending operation whereby needless extension of the arc is controlled to prevent excess arc energy in the arc space and to prevent the elevation of excess temperature of the fluid. Moreover, the movable contact (4) stays for a long time in the surounding shell (23) whereby the relation of the passage (41) to the pressurizing chamber (22) is maintained stable to impart excellent stable function even in the relative position for expanding the arc.

In accordance with the present invention, the circuit interrupter comprises a pair of detachable contacts and the fluid for arc extinction which is pressurized by the arc formed between the contacts and the arc extinct chamber fluid with the fluid and the control device which is connected to the driving system for the contact and which control the departing speed of the movable contact in two steps to puff the pressurized fluid resulted by the arc formed between the contacts and stored in the arc extinct chamber, whereby the function of arc extinction can be significantly improved by effectively controlling the pressurizing function by a simple structure.

What is claimed is:

1. In a circuit interrupter comprising a pair of detachable contacts, and means for puffing the arc between the contacts including an arc extinct chamber filled with a fluid for arc extinction which is pressurized by the arc formed between the contacts when they are disengaged, said pair of detachable contacts being at least one movable contact and at least one fixed contact; an improvement which comprises control means including a control device for controlling a departing speed of the movable contact after disengagement from said fixed contact in at least two steps and said control means further including at least two springs exerting force against said control device to force the movable contact mounted thereon out of engagement with the fixed contact at an accelerated rate; said at least two springs driving the movable contact until the movable contact is located a specified distance from the fixed contact; one of said at least two springs ceasing to work against said movable contact at this point and causing a reduction in the accelerated rate of disengagement to prevent rapid extension of the arc and thereby prevent excess arc energy from forming in the arc space between the movable contact and the fixed contact and to prevent the fluid from reaching an elevated temperature; the other of said at least two springs continuing the opening movement of the movable contact out of said arc extinct chamber at a decelerated rate to thereafter puff the pressurized fluid in the arc extinct chamber which is pressurized by the arc formed between the movable contact and the fixed contact to thereby control arc extinguishment by controlling the departing speed of the movable contact.

2. A circuit interrupter according to claim 1 wherein the pressurized fluid is puffed to the arc in the latter step of said at least two steps.

3. A circuit interrupter according to claim 1 wherein the movable contact includes an outlet which is maintained in a closed state until the movable contact is shifted the specified distance from the fixed contact and which is opened to discharge the pressurized fluid stored in the arc extinct chamber.

4. A circuit interrupter according to claim 1 or 2 wherein the arc extinct chamber comprises a body in which the fixed contact is disposed, a pressurizing chamber for storing the pressurized fluid for arc extinction which is disposed to one side of the body and a surrounding shell for surrounding the movable contact which is disposed to the other side of the body.

5. A circuit interrupter according to claim 4 wherein the movable contact includes an outlet for puffing the pressurized fluid for arc extinction from the arc extinct chamber and the surrounding shell has a length for maintaining the outlet of the movable contact in the closed state until the movable contact is shifted the specified distance and the length of the surrounding shell is extended in the direction in which the movable contact shifts.

* * * * *